US005203505A

United States Patent [19]

Yum

[11] Patent Number: 5,203,505

[45] Date of Patent: Apr. 20, 1993

[54] GRAVITY FED HUMIDIFIER

[76] Inventor: Pil M. Yum, 4701 Americana Dr., #302, Annandale, Va. 22003

[21] Appl. No.: 885,539

[22] Filed: May 19, 1992

[51] Int. Cl.[5] ..... B01F 3/04

[52] U.S. Cl. ..... 239/43; 261/106

[58] Field of Search ..... 239/43; 261/106, 103

[56] References Cited

U.S. PATENT DOCUMENTS

| | | | |
|---|---|---|---|
| 191,710 | 6/1877 | Pfanne . | |
| 420,317 | 1/1890 | Swift . | |
| 430,161 | 6/1890 | Woods . | |
| 430,162 | 6/1890 | Woods . | |
| 447,942 | 3/1891 | Collins . | |
| 489,033 | 1/1893 | Proctor | 239/43 |
| 1,117,612 | 11/1914 | Thompson | 261/103 |
| 1,514,564 | 11/1924 | Newcomer . | |
| 3,092,096 | 6/1963 | Nett et al. | 261/103 |
| 3,254,841 | 6/1966 | Loncker, Sr. . | |
| 4,270,696 | 6/1981 | Pointer, Jr. . | |
| 4,428,890 | 1/1984 | Harrell | 261/106 |
| 5,121,770 | 6/1992 | Thompson | 261/106 |

*Primary Examiner*—Tim Miles

*Attorney, Agent, or Firm*—Burns, Doane, Swecker & Mathis

[57] ABSTRACT

A gravity fed humidifier has a reservoir for holding a liquid to be evaporated. The reservoir has openings in the bottom of the reservoir through which the liquid passes and two side walls extending upwardly from the bottom wall. The reservoir is suspended over an absorbent material by at least one support leg to which is attached a circular support surface for supporting the absorbent material. A drip tray is provided beneath the absorbent material and the openings for catching liquid that is not evaporated by the surrounding air.

4 Claims, 1 Drawing Sheet

GRAVITY FED HUMIDIFIER

FIELD OF THE INVENTION

The present invention relates to the field of gravity fed vaporizing and watering devices, and more particularly to a gravity fed vaporizing and watering device adaptable to various purposes and of a space saving design.

BACKGROUND OF THE INVENTION

Gravity fed vaporizing devices have been used for a wide range of vaporizing and watering purposes. As is pointed out in U.S. Pat. No. 3,254,841, such devices may be used to eliminate or cover up undesired scents, or to dispense volatile chemicals over extended periods of time, such as during pest control operations. Another application for such devices is described in U.S. Pat. No. 4,270,696, which describes a drip irrigator for watering plants. Further, such devices are commonly used as simple means for humidifying dry air.

The method of operation of such devices is generally as follows. An absorbent material, such as a towel or an absorbent wick is immersed in a liquid, or has liquid placed on it, so that a wicking or spreading effect occurs and the liquid moistens as much of the absorbent material as the user desires. Depending upon how much liquid is made available, the absorbent material can become entirely saturated. Natural or forced air flowing past the absorbent material causes the liquid to evaporate into the local atmosphere. Greater air flow and higher temperatures will cause faster evaporation of the liquid. Similarly, exposing more moistened surface area of the absorbent material to air speeds the introduction of evaporated material to the surrounding air. Unfortunately, whether for aesthetic reasons or because of space limitations, it is often not practical to use a large gravity fed humidifier in many circumstances and, as a consequence, the non-industrial application of such devices is often limited to quite small-scale uses such as room freshening and the like.

While such devices do not, as a general rule, introduce moisture into the air as quickly as devices such as steam humidifiers, they are also less dangerous in that there are not normally any electrical components capable of contacting water and there is no high temperature steam that might cause burns. Further, because of their relative simplicity, they are generally inexpensive to manufacture and sell, and easy to use.

It is desirable to provide an attractive, gravity fed humidifier in which a maximum amount of absorbent material can be exposed to dry air in a minimal amount of space while avoiding the dangers of other types of humidifiers.

SUMMARY OF THE INVENTION

In accordance with one aspect of the present invention, a gravity fed humidifier is provided having a reservoir for containing water and a plurality of spaced-apart openings extending through a lower surface of the reservoir. A frame supports the reservoir and has at least one support surface vertically below the openings. An absorbent material overlies the support surface such that liquid in the reservoir passes through the openings and onto the absorbent material. A drip pan is located at the lower end of the frame for collecting liquid that drips from the absorbent material.

In a further aspect of the present invention, the reservoir and frame are of an annular shape, the drip pan is of a circular shape, and absorbent material overlies the support surface to form a generally cylindrical shaped humidifier.

BRIEF DESCRIPTION OF THE DRAWINGS

The features and advantages of the present invention will be well understood by reading the following detailed description in conjunction with the drawings in which like numerals indicate similar elements, and in which.

DETAILED DESCRIPTION

Figure 1:
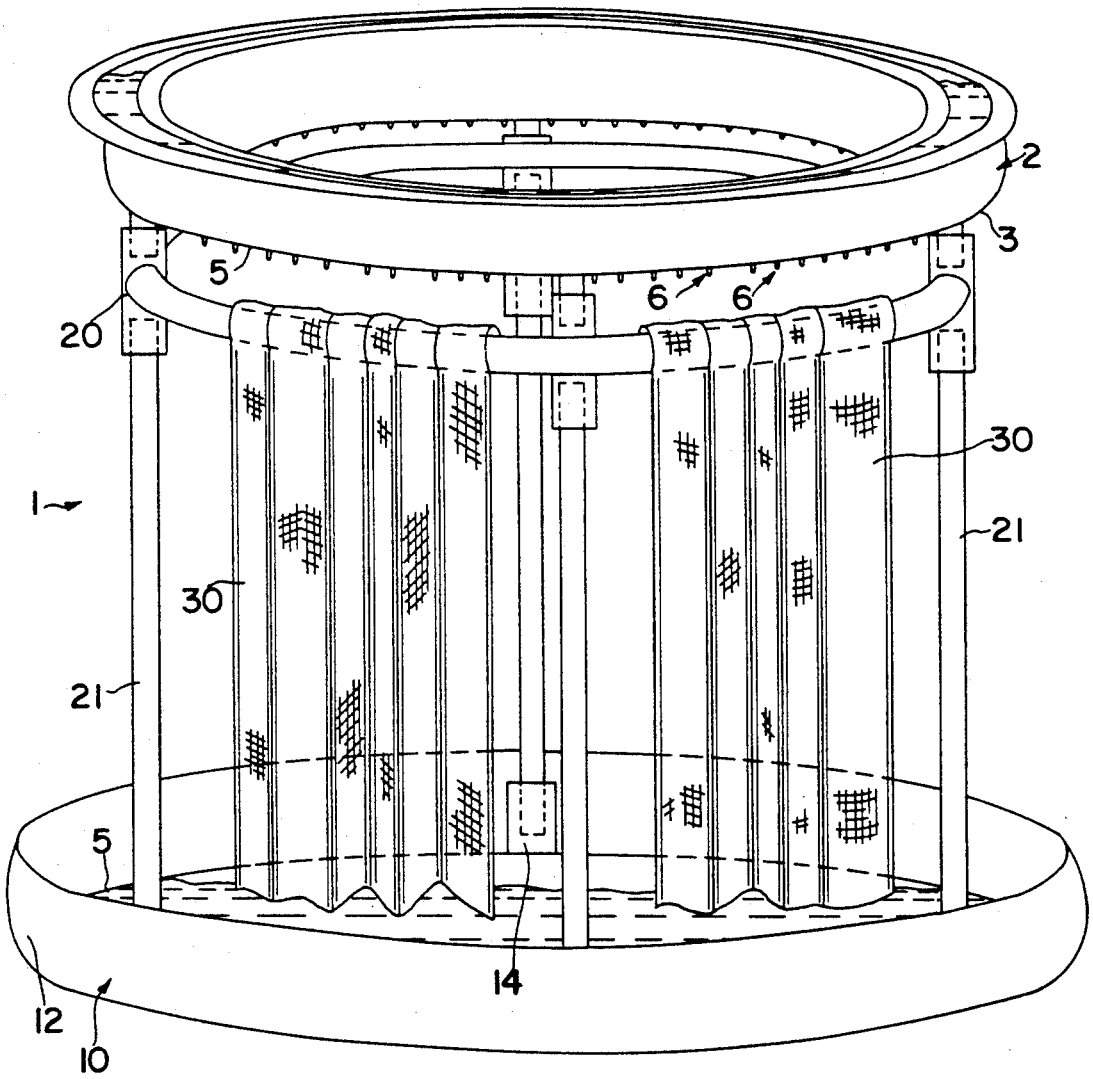
FIG. 1 is a perspective front view of a gravity fed humidifier according to an embodiment of the present invention.

With reference to FIG. 1, a gravity fed humidifier 1 includes a reservoir 2 for containing a liquid (not shown) to be evaporated. The reservoir 2 is supported over a drip pan 10 by one or more vertical legs 21. The leg 21 is preferably attachable to and detachable from a point at the outer surface 3 of the reservoir 2 to facilitate breakdown of the humidifier. However the leg 21 may also be permanently fastened to the reservoir.

The reservoir 2 is provided with a plurality of openings 6 at the bottom 5 of the reservoir. The position of the openings 6 and the size of the outer periphery 12 of the drip pan 10 are such that the openings 6 are disposed within an imaginary vertical cylinder defined by the outer periphery 12. The openings are sized such that the liquid that is desired to be evaporated will drip from the reservoir at a desired rate.

Each leg 21 extends from the reservoir to a position on the bottom 5 of the drip pan 10. While the leg 21 may be adapted to support the reservoir 2 over the drip pan 10 by means other than being fastened to the drip pan, such as by an independent stand (not shown), the leg 21 is preferably attachable by suitable means 14 to and detachable from the drip pan 10.

Attached to the leg 21 and positioned underneath the openings 6 in the reservoir 2 is a support surface 20 for supporting an absorbent material 30. The support surface 20 is preferably a circular rod upon which an absorbent material 30 such as a cloth or synthetic fabric is draped.

The drip pan 10 is depicted, in FIG. 1, as being of a dish shape. The drip pan 10 is of sufficient width to capture substantially all of the liquid that might drip from the reservoir 2 or the absorbent material 30.

The humidifier assembly may be of any desired polygonal or other geometrical shapes. Ideally, the shape of the humidifier assembly will permit accommodation of various desired structures within its periphery, when desired, as well as conform to the space and aesthetic requirements of its immediate environment. Humidifier assemblies in closed geometrical shapes such as circles, triangles, and rectangles are particularly advantageous because of their pleasing appearance to the eye, as well as because of their ability to maximize the exposed surface area of the absorbent material.

Ideally, it will be known before construction of the humidifier assembly what the viscosity of the liquid (e.g., water) being evaporated will be, and how much liquid is desired to be evaporated, and it will thereby be possible to form holes 6 of a desired size such that a desired flow or drip rate of the liquid can be attained. Further, the height of the humidifier assembly and the length of the absorbent material 30 and, consequently, the amount of exposed surface area of the absorbent material, can be determined beforehand in accordance with projected humidifying requirements.

The operation of the humidifier assembly 1 will now be explained. The reservoir 2 of the humidifier assembly 1 is filled with a liquid (not shown). The liquid in the reservoir 2 drips through the holes 6 onto the absorbent material 30. Air passes the absorbent material 30 and evaporates the liquid. More liquid can be evaporated by forcing air against the surface of the absorbent material 30 or by heating the air prior to directing it toward the absorbent material.

It is, of course, possible to embody the invention in specific forms other than those described above without departing from the spirit of the present invention. The embodiments described above are merely illustrative and should not be considered restrictive in any way. The scope of the invention is given in the appended claims, rather than the preceding description, and all variations and equivalents which fall within the range of the claims are intended to be embraced therein.

What is claimed is:

1. A gravity fed humidifier, comprising:

a reservoir for containing a liquid to be evaporated, the reservoir having a plurality of openings extending through a bottom wall of the reservoir through which the liquid passes, the reservoir having an annular configuration with two side walls extending upwardly from the bottom wall;

at least one support leg for supporting the reservoir;

an absorbent material for absorbing the liquid passing from the reservoir; and a circular support member, attached to the support leg, for supporting the absorbent material beneath the openings in the bottom of the reservoir.

2. A gravity fed humidifier as set forth in claim 1, further comprising a drip tray for capturing liquid passing from the reservoir.

3. A gravity fed humidifier as set forth in claim 1, wherein the support member is detachable from the leg.

4. A gravity fed humidifier as set forth in claim 1, wherein the reservoir is circular.

* * * * *